US006015058A

United States Patent [19]

Parks

[11] Patent Number: 6,015,058

[45] Date of Patent: Jan. 18, 2000

[54] PAINTBALL GUN LOADER

[75] Inventor: Gerald R. Parks, Chula Vista, Calif.

[73] Assignee: John R. Gregory, Bonita, Calif.

[21] Appl. No.: 09/149,720

[22] Filed: Sep. 8, 1998

[51] Int. Cl.[7] ..... B65D 43/14; B65D 43/22; B65D 51/00

[52] U.S. Cl. ..... 220/229; 220/8; 220/320; 220/345.2; 220/345.4; 220/351

[58] Field of Search ..... 220/229, 8, 4.11, 220/345.4, 348, 263, 264, 910, 911, 826, 319, 320, 345.2, 351; 221/65, 64, 303, 306, 307, 310, 288, 185, 186

[56] References Cited

U.S. PATENT DOCUMENTS

| | | | |
|---|---|---|---|
| 1,810,491 | 6/1931 | McClure | 221/185 |
| 2,404,815 | 7/1946 | Satz et al. | 220/826 |
| 2,567,218 | 9/1951 | Lemire | 220/264 |
| 2,878,060 | 3/1959 | Russo | 220/8 |
| 3,499,574 | 3/1970 | Yates, Jr. | 220/320 |
| 3,642,166 | 2/1972 | Starr | 220/320 |
| 3,836,037 | 9/1974 | Bass | 220/264 |
| 4,549,693 | 10/1985 | Barlics | 220/8 |
| 5,322,179 | 6/1994 | Ting | 220/264 |
| 5,687,867 | 11/1997 | Lamoureux | 220/229 |

*Primary Examiner*—Stephen P. Garbe
*Assistant Examiner*—Niki M. Eloshway
*Attorney, Agent, or Firm*—Henri J. A. Charmasson; John D. Buchaca

[57] ABSTRACT

A container which can be held and opened by one hand has a dome-shaped cap formed by a series of adjacent, contiguous and ogee-shaped segments resiliently held together by an elastic ring. When the cap is forced down over the opening rim of the vessel, the ogee-shaped segment separate to expose the vessel opening.

9 Claims, 2 Drawing Sheets

FIG. 1
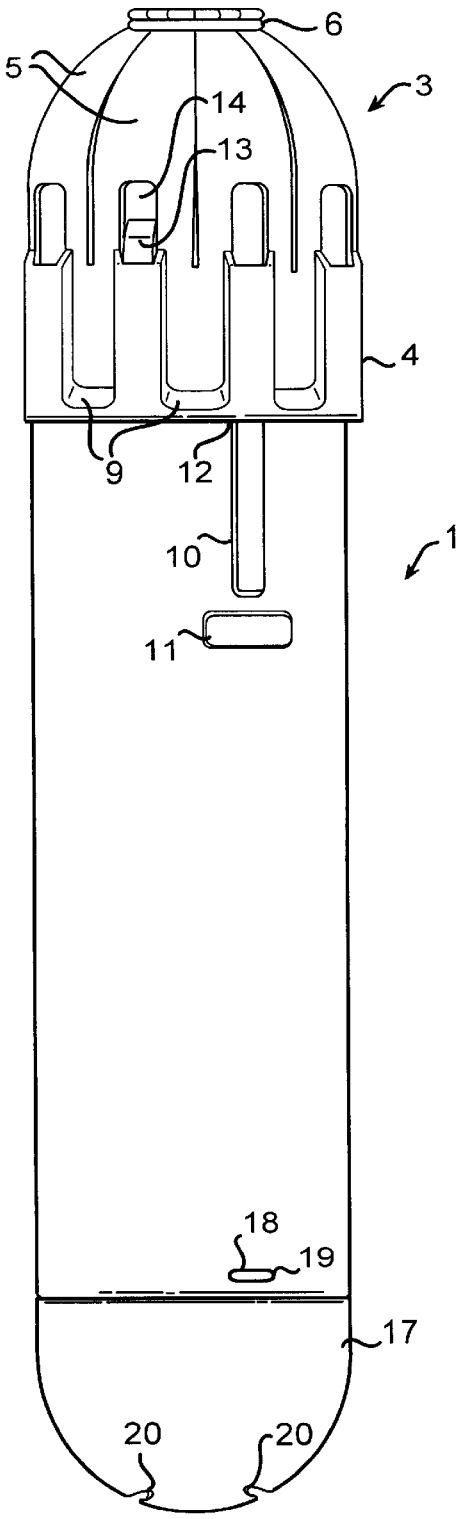
FIG. 2
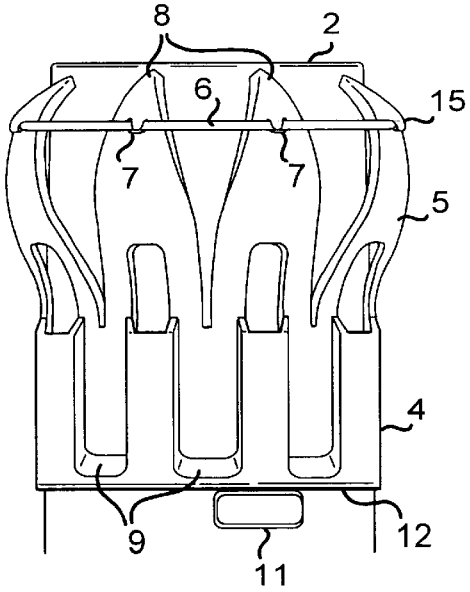
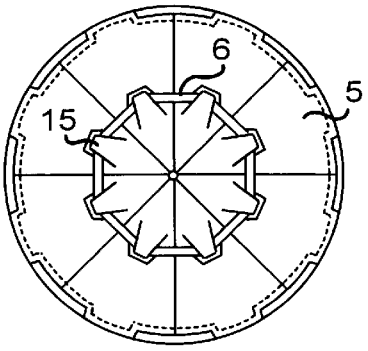
FIG. 3
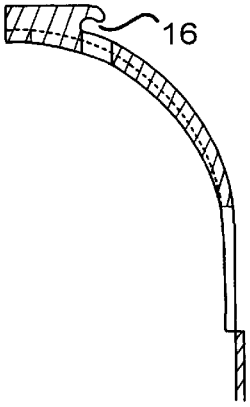
FIG. 4

PAINTBALL GUN LOADER

FILED OF THE INVENTION

This invention relates to sealing caps for cylindrical containers or containers having a cylindrical spout, and more particularly to caps which can be manipulated by the same hand holding the container.

BACKGROUND OF THE INVENTION

In many life situations, it is advantageous to use containers that can be opened and shut by movement of the thumb of the very hand that holds the container. One can think of the situation where one hand is busy stirring a preparation and small amount of various other products may have to be added to that preparation such as in a kitchen or laboratory environment. In the old days, a warrior using a muzzle-loaded rifle would reach for a powder cartridge with one hand while holding the rifle with the other. He would then rip the top of the carton cartridge with his teeth before pouring its contents into the muzzle. A similar situation is encountered today when participants in paintball games must reload their weapon with a new supply of paintballs. Prior art paintball containers have an hinged top which still requires to be opened with two hands or use of the mouth.

This invention results from efforts to provide a more convenient form of paintball gun loading containers.

SUMMARY OF THE INVENTION

The principal and secondary objects of this invention are to provide a simple and economical type of plastic container that can be held with one hand and opened then closed by movement of the thumb of that same hand, and without offering any interference across the opening of the container.

These and other valuable objects are achieved by a dome-shaped cap which is formed of a series of adjacent and contiguous ogee-shaped segments that come together under the action of an elastic ring to form a dome. The segments are mounted on an annular ring that slips over the cylindrical opening of the container. By pushing the annular ring down, the rim of the container causes the ogee-shaped segment to separate and expose the opening without any interference.

BRIEF DESCRIPTION OF THE DRAWING

FIG. 1 is a front elevational view of a paintball container having a cap according to the invention;

FIG. 2 is a elevational view of the cap in an open position;

FIG. 3 is a top plan view of a cap in the closed position;

FIG. 4 is a cross-sectional view of an alternate embodiment of the cap;

DESCRIPTION OF THE PREFERRED EMBODIMENT OF THE INVENTION

Figure 5:
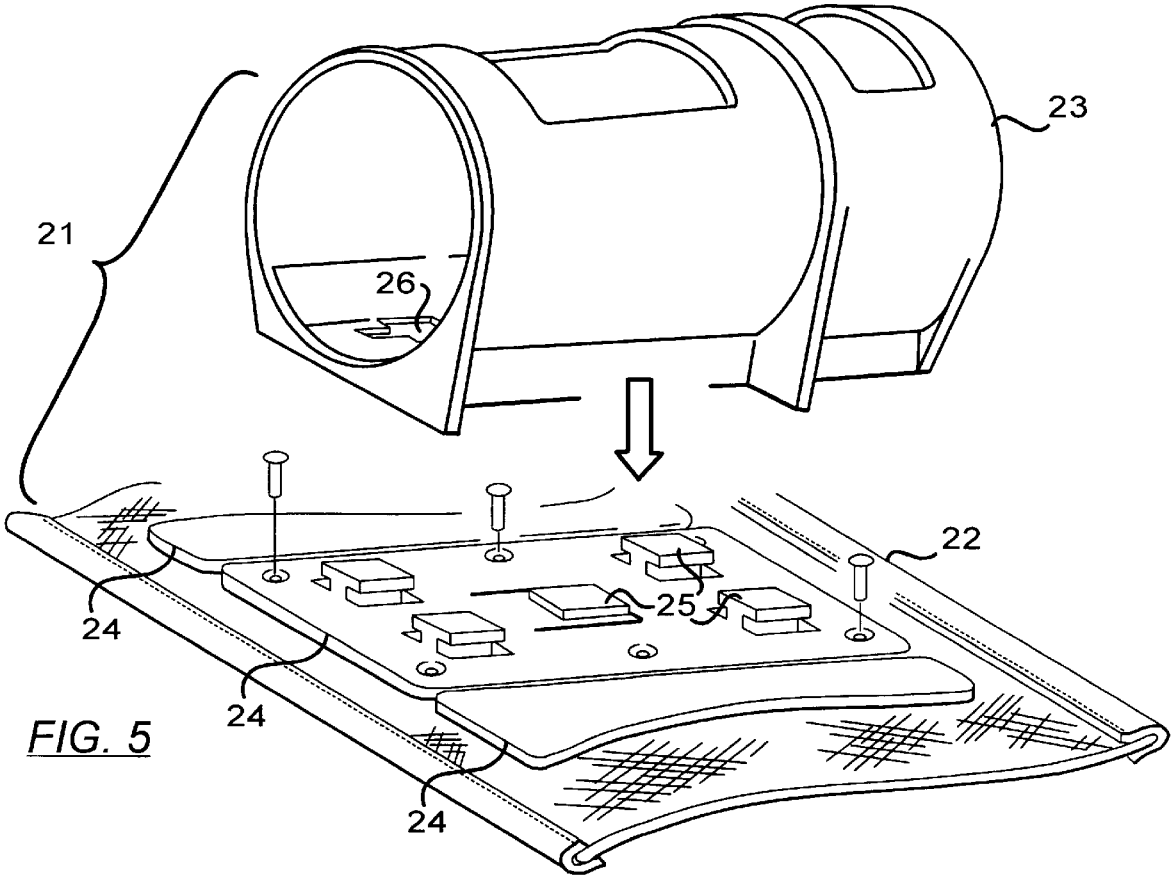
FIG. 5 is an exploded view of a holster for the paintball container.
Figure 6:
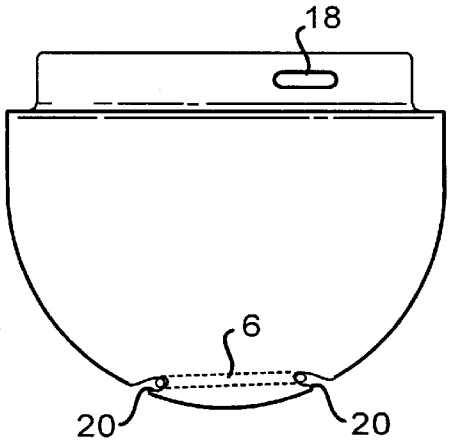
FIG. 6 is a view of a bottom cap.

Referring now to the drawing, there is shown a container 1 having a cylindrical opening rim 2 closed by a dome-shaped cap 3. It should be noted that the invention is adaptable to any container having a cylindrical pouring spout. The cap comprises an annular ring 4 which is dimensioned to intimately slip over the rim 2. Projecting from the upper ridge of the ring, are a series of contiguously adjacent ogee-shaped segments 5 which are biased toward one another by an elastic ring 6 captured in recesses 7 in the upper portion of each segment. When the apexes 8 of the segments are brought together, a closed dome is formed over the container rim. Alternatively the segments 5 may be made of a resiliently flexible material and molded into their arcuate closing positions so that they automatically draw toward one another when not forced back by the opening rim 2. A series of indentations 9 practiced over the outer surface of the annular ring facilitates pushing down the ring over the neck of the container so that the ogee-shaped segments are forced to separate from one another to expose the opening rim 2 without any interference. A longitudinal slide bar 10 is provided just below the opening rim that nest in a corresponding groove cut into the inner wall of the annular ring so as to prevent the cap from spinning during operation. The maximum downward excursion of the sliding ring is limited by a stop bar 11 against which the lower edge 12 of the annular ring comes to rest. The maximum upward excursion of the cap is set by a stop nib 13 projecting from the outer wall of the rim through a small depression or opening 14 in the lower section of one or more of the ogee-shaped segments. It should be noted that due to the shape and position of the stop nib 13, it disengages easily from the opening 14 when the annular ring is pushed down. The recesses 7 into which the elastic ring is captured are formed by a simple U-shape cut into each segment that nests a section of the ring under the tongue segment 15 thus formed. Illustrated in FIG. 4, is an alternate version of the cap in which the recesses 16 for the elastic ring are formed in the molding of the cap segments. The opposite end of the container is sealed by a removable hemispherical cap 17 which is held in place by a nib 18 extending from the container outer rim wall of the bottom cap into an opening 19 along the lower edge of the container. On the apex surface of the bottom cap 17, a pair of asymmetrical and diametrically opposed projections 19 and 20 are conveniently provided to hold a number of spare elastic rings which may be constituted by appropriately sized O-ring seals.

Illustrated in FIG. 5 is a holster 21 adapted for seating and holding the paintball container 1. The holster comprises a belt 22 to which a slightly tapering near-cylindrical receiver 23 shaped and dimensioned to nest a container 3 can be attached. A plaque 24 permanently riveted to the belt has a plurality of prongs 25 which are shaped and dimensioned to engage and slide into corresponding apertures 26 in the wall of the receiver. It should be noted that several plaques 24 can be riveted along the belt so that a user may carry a number of paintball containers.

While the preferred embodiments of the invention have been described, modifications can be made and other embodiments may be devised without departing from the spirit of the invention and the scope of the appended claims.

What is claimed is:

1. A self-sealing cap slidably engaged over the cylindrical opening rim of a vessel, said cap comprising:

an annular wall having a lower edge shaped and dimensioned to slip over said rim;

substantially symmetrical, separate, contiguous and substantially triangular segments each extending from said annular wall to a tapering apex portion; and resilient means for biasing said apex portions toward one another to form a segmented dome over said annular wall;

whereby when said annular wall is slided down over said rim, the rim causes said segment to pull apart and expose said rim, and when said annular wall is moved upwardly away from said rim, the apex portions move back toward one another.

2. The cap of claim 1, wherein said segments are arcuate and ogee-shaped.

3. The cap of claim 1, wherein said means for biasing comprises an elastic ring surrounding said apex portions.

4. The cap of claim 3, wherein each of said apex sections has a recess shaped to received a section of said elastic ring.

5. A paintball projectile container which comprises a tubular body having the cap of claim 4 at one end.

6. The container of claim 5, which further comprises a hemispherical second cap at an opposite end.

7. The container of claim 6, wherein said second cap comprises a pair of diametrically opposed projections shaped and spaced apart to hold a plurality of space elastic rings.

8. The container of claim 5, which further comprises a tubular holster shaped and dimensioned to receive and hold said tubular body.

9. The cap of claim 1, wherein said means for biasing comprises said segments being made of resiliently flexible material.

* * * * *